US005245990A

United States Patent [19]

Bertinin

[11] Patent Number: 5,245,990

[45] Date of Patent: Sep. 21, 1993

[54] APPARATUS FOR ENHANCING VENOUS CIRCULATION AND FOR MASSAGE

[76] Inventor: Millo Bertinin, 679 Garden St., Trumbull, Conn. 06611

[21] Appl. No.: 835,403

[22] Filed: Feb. 14, 1992

[51] Int. Cl.[5] ..... A61H 7/00

[52] U.S. Cl. ..... 128/64; 128/38

[58] Field of Search ..... 128/64, 38–40, 128/24 R

[56] References Cited

U.S. PATENT DOCUMENTS

| | | | |
|---|---|---|---|
| 2,528,843 | 11/1950 | Poor | 128/24 R |
| 3,403,673 | 10/1968 | MacLeod | 128/64 |
| 3,590,815 | 7/1971 | Schiff | 128/64 |
| 3,811,431 | 5/1974 | Apstein | 128/64 |
| 3,866,604 | 2/1975 | Curless et al. | 128/64 |
| 4,013,069 | 3/1977 | Hasty | 128/DIG. 15 X |
| 4,253,449 | 3/1981 | Arkans et al. | 128/64 X |
| 4,374,518 | 2/1983 | Villanueva | 128/64 |
| 4,762,121 | 8/1988 | Sheinfeld | 128/25 R X |
| 4,793,328 | 12/1988 | Kolstedt et al. | 128/64 X |
| 4,858,596 | 8/1989 | Kolstedt et al. | 128/64 X |
| 4,865,020 | 9/1989 | Bullard | 128/64 |
| 4,986,260 | 1/1991 | Iams et al. | 128/64 X |
| 5,022,387 | 6/1991 | Hasty | 128/64 |
| 5,041,681 | 5/1991 | Neema et al. | 128/64 |

*Primary Examiner*—Robert A. Hafer
*Assistant Examiner*—Brian E. Hanlon
*Attorney, Agent, or Firm*—Arthur T. Fattibene; Paul A. Fattibene

[57] ABSTRACT

This disclosure is directed to a method and apparatus for enhancing venous circulation in persons having venous insufficiencies and/or for effecting muscular massage for preventing muscle atrophy. This is attained by a wrap or sleeve adapted to circumscribe the portion of the body to be treated which includes an inflatable flexible tubing or tube which is inflated and deflated for producing a smooth, progressive massaging force on the body portion being treated. In one form of the invention, a plurality of independent inflatable tubes are arranged to circumscribe the body portion to be treated and are arranged to be sequentially inflated by a valving piston reciprocating in a supply manifold disposed in communication with each of the independent inflatable tubes. In operation, a fluid pressure inflates the respective tubes in a progressive manner whereby a massaging force is progressively applied against the body part as the tubes are sequentially inflated and which massaging force is relieved when the tubes are deflated. In another form of the invention, the inflatable tube is in the form of a continuous zigzag pattern having a series of reverse bends and which is wrapped about the portion of the body to be treated. A cord is threaded through the inflatable tube to maintain the continuity of the flow of fluid pressure through the tubing. A control circuit is provided to control the inflation and deflation of the flexible tubing to effect a repetitive cycle in a predetermined time sequence.

4 Claims, 4 Drawing Sheets

APPARATUS FOR ENHANCING VENOUS CIRCULATION AND FOR MASSAGE

This invention is directed to a method and an apparatus for improving or enhancing venous circulation in persons having venous insufficiencies and for providing muscular massage to prevent muscle atrophy.

PRIOR ART

Heretofore, various types of appliances have been conceived to facilitate rehabilitations of injured body parts by promoting venous blood flow. A number of such therapeutic devices are known, as evidenced by U.S. Pat. Nos. 2,168,611; 2,531,074; 3,824,992; 4,370,975; 3,094,116; 4,702,232; 4,805,601; RE 32,939 and RE 32,940. Other therapeutic appliances are evidenced by U.S. Pat. Nos. 3,888,242 and 4,573,453, which relate primarily to massaging various body appendages. U.S. Pat. No. 4,421,109 is directed to an apparatus for simulating gravitational forces on the body and U.S. Pat. No. 3,908,642 is a means for applying forced air in a body cast to alleviate the discomfort of a body part confined to a cast for a considerable period of time. For the most part, the prior known devices as noted are relatively complex in structure and costly to fabricate.

OBJECTS

An object of this invention is to provide a relatively simple and inexpensive appliance for enhancing venous circulation and/or for massage.

Another object is to provide an appliance and method for subjecting the body part to be treated to a progressively applied positive pressure in a predetermined timed cyclical sequence that enhances venous circulation with a comforting massage effect.

Another object of this invention is to provide a method and apparatus for applying a progressive wave-like massaging effect on a body part to be treated by progressively inflating an inflatable member circumscribing the body part to impart a positive pressure thereon and thereafter deflating the inflatable member and repeating the cycle in a timed sequence.

SUMMARY OF THE INVENTION

The foregoing objects and other features and advantages are attained by a wrap or sleeve which is adapted to circumscribe the body part to be treated and which has connected thereto an inflatable tube. In one form of the invention, the inflatable tube includes a plurality of independent tubes adapted to circumscribe a body part at predetermined spaced intervals. Each of the independent tubes are connected in communication with a fluid supply manifold. Reciprocally mounted within the supply manifold is a slidable piston to sequentially valve the inlet of the independent tubes. The arrangement is such that the respective tubes are sequentially inflated to impart a pressure on the body part with a wave-like massaging rhythm. The piston is connected to a motor or spring for effecting the return stroke of the piston. Fluid pressure is applied to the supply manifold through a solenoid valve controlled by a suitable timer. The arrangement is such that fluid pressure is supplied to the manifold when the solenoid valve is actuated to effect the displacement of the piston. The displacement of the piston effects a sequential opening of the inlet to each of the independent inflative tubes to effect the successive inflation thereof to impart a wave-like massage effect on the body part. At the end of the piston stroke, the solenoid valve is shifted to an exhaust position whereby the inflatable tubes are deflated, whereupon the piston is returned to its initial position, either under a spring action or by a drive motor; and the cycle repeated.

In another form of the invention, the sleeve is defined by a wrap having connected thereto a continuous inflatable tube disposed in a zigzag pattern. A cord is threaded through the inflatable tube to insure against total closing of the tube at the reverse bends thereof. In this form of the invention, when the solenoid valve is actuated, fluid pressure will progressively inflate the successive bends of the zigzag tube to impart a continuous wavelike pressure to the body part. Upon the complete inflation of the tube, the solenoid valve is shifted to exhaust the fluid pressure within the tube to effect the deflation thereof, and the cycle is repeated in a timed sequence.

FEATURES

A feature of this invention resides in the provision of a shell or wrap arrange to circumscribe a portion of the body and having connected thereto an inflatable tube which is progressively inflated to impart a wave-like massaging pressure on the body part.

Another feature resides in the provision of a plurality of inflatable tubes disposed in a shell circumscribing a body part wherein the respective tubes are sequentially inflated to provide a wave-like massaging pressure on the body part.

Another feature resides in the provisions of a body wrap having connected thereto a continuous inflatable tube disposed in a zigzag pattern in which the respective sections of the inflatable tube are sequentially inflated to provide the wave-like massaging pressure on the body part.

Another feature resides in the provision of a cord threaded through the inflatable tube when disposed in a zigzag pattern to prohibit total closing of the tube at the reverse bends thereof.

Other features and advantages will be rendered apparent in view of the following detail described and drawings in which.

DETAIL DESCRIPTION

Figure 1:
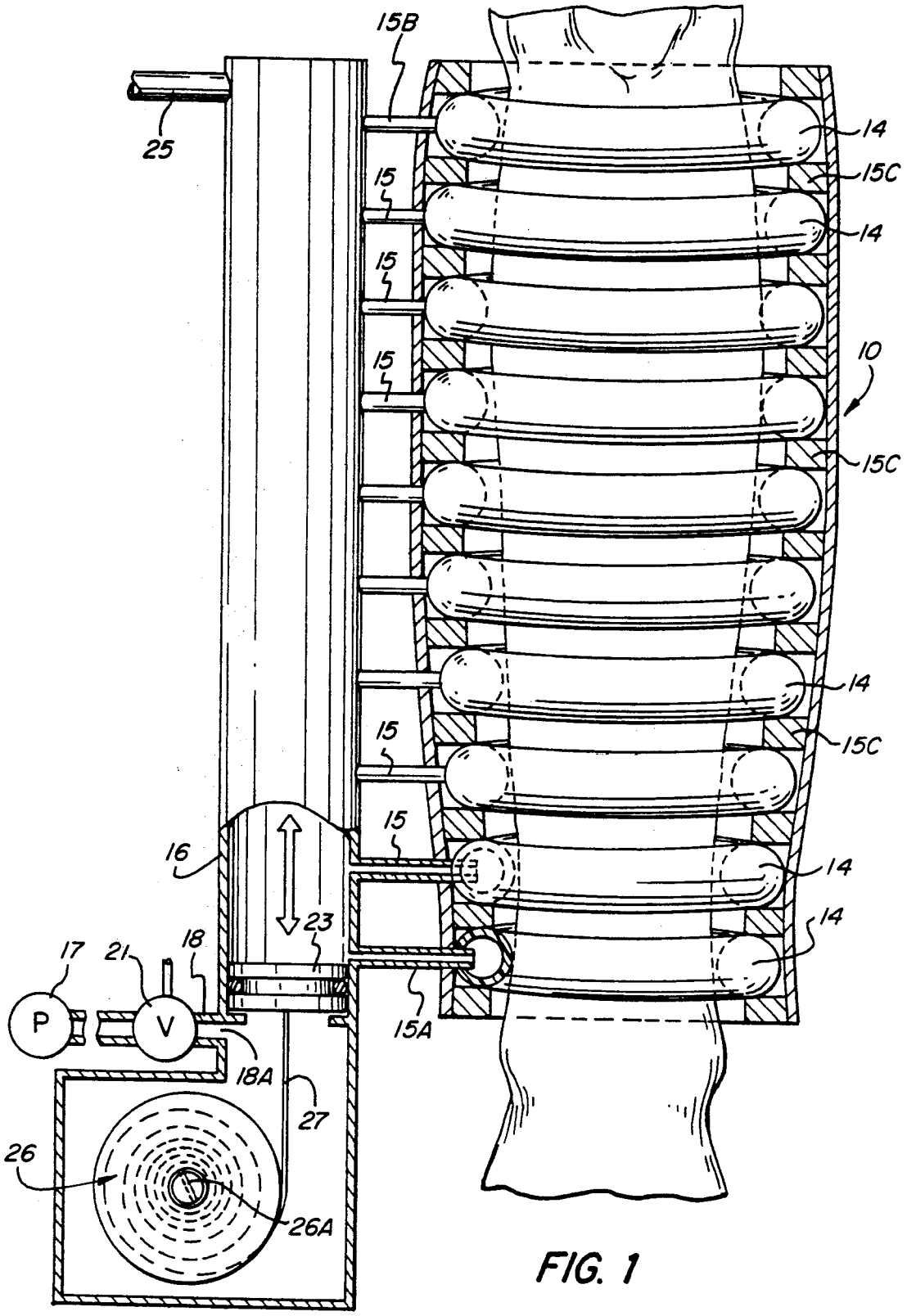
FIG. 1 is a vertical sectional view of a pressure applying device embodying the invention.
Figure 2:
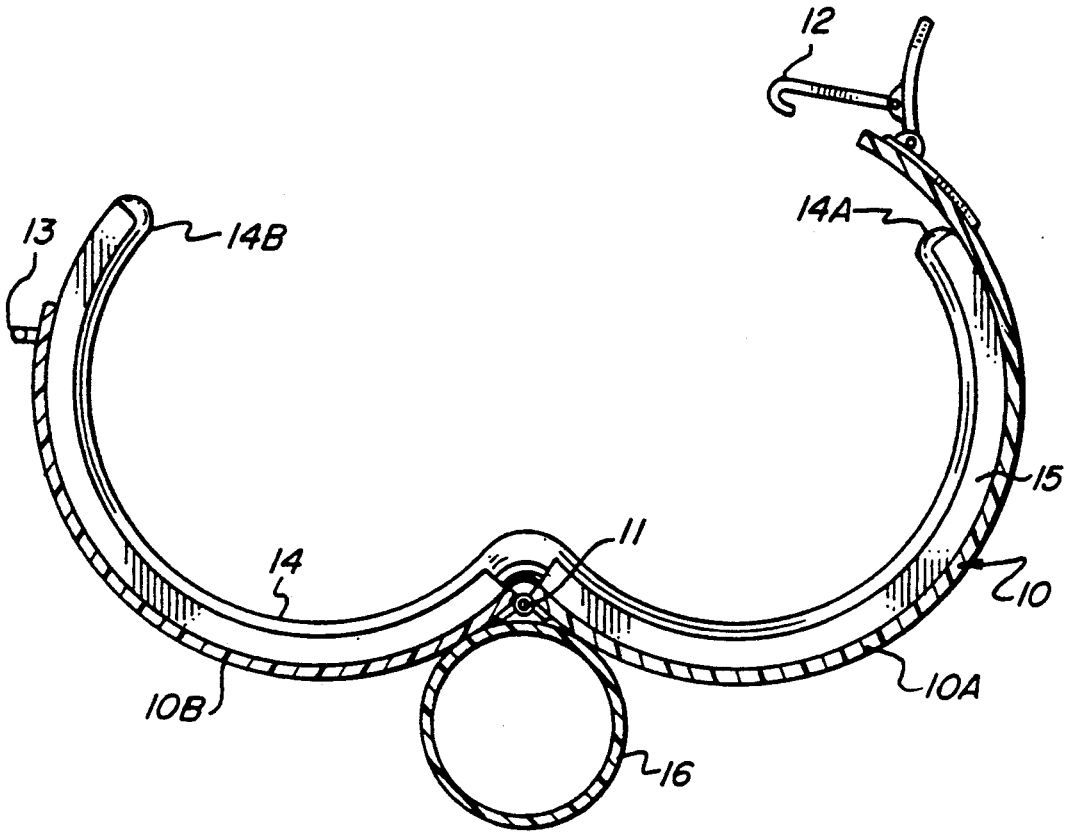
FIG. 2 is a cross-sectional view of the device of FIG. 1 illustrated in the opened position thereof.
Figure 3:
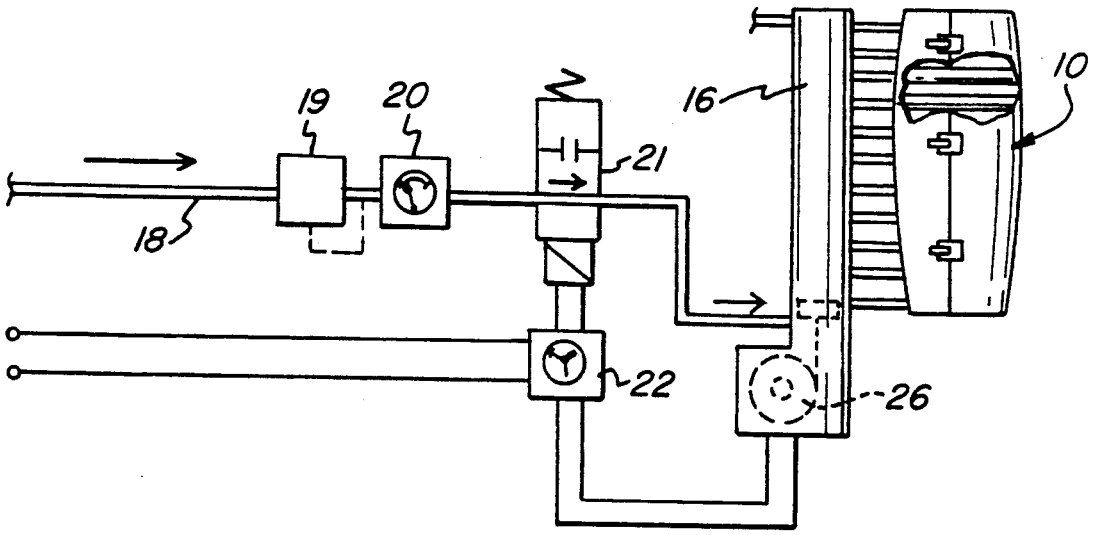
FIG. 3 is a diagrammatic showing of the control circuit.

Referring to the drawings, there is illustrated in FIGS. 1 to 3 a preferred embodiment of the invention. As shown, the invention comprises a shell or wrap 10 which is adapted to encircle a body portion or part to be treated. In the illustrated embodiment, the shell 10 is adapted to encircle a leg. To facilitate applying the shell 10 to the body part, e.g. a leg, the shell is formed of two half sections 10A, 10B connected by a suitable hinge 11 whereby the respective sections can be readily applied to and removed from the body part. Preferably, the respective shell sections 10A and 10B are formed of a suitable rigid material, e.g. plastic or light weight metal. A suitable latch 12 and complementary catch is provided for latching the respective shell section onto the body part when a massaging pressure is to be applied to the body part. Secured to the respective sections 10A and 10B are a plurality of inflatable tubes 14. As best seen in FIG. 3, the respective tubes are longitudinally spaced along the length of the shell; with a suitable spacer 15 disposed between adjacent pairs of inflatable tubes. As best seen in FIG. 2, each tube 14 comprises an elongated inflatable tube which is closed at its ends 14A, 14B. The tube 14 is formed of readily flexible material so that when the shell is closed about the body part, the tube 14 can readily encircle the body part to be treated. The respective tubes are suitably connected to the respective shell sections 10A, 10B by any suitable means. While the shell 10 is illustrated as being generally cylindrical, it will be understood that the shell 10 may be formed to substantially conform to the shape of the body part being treated. The shell is also proportioned so that when the tubes 14 are inflated as hereinafter described, a pressure is applied to the adjacent body part.

In the illustrated embodiment and as best seen in FIG. 1, each inflatable tube 14 is provided with a nipple 15 through which a fluid pressure is permitted to flow to inflate and deflate the tube 14. Connected in communication with each of the nipples is a supply manifold 16. The supply manifold 16, in turn, is connected to a source of fluid pressure, e.g. an air compressor 17 or other suitable source of an actuating fluid by means of a connecting conduit 18. Disposed in the conduit 18 is a suitable regulator 19, pressure gauge 20, and a solenoid valve 21, as best seen in FIG. 3. The solenoid valve 21 is a suitable electrically controlled valve having a first position for directing fluid pressure to tubes 14 when actuated to inflate the tubes and a second position to effect deflation of the tubes 14. The actuation of the solenoid valve is effected by a suitable timer 22 connected to a circuit therewith as shown in FIG. 3 to effect actuation of the solenoid valve between its inflating and deflating positions in a controlled timed sequence.

Slidably disposed within the supply manifold 16 is a reciprocating piston 23. In the normal inoperative position, the piston 23 is disposed between the pressure supply inlet 18A to the manifold 16 and the first nipple or fluid inlet 15 of the lowermost tub 14. The arrangement is such that when the solenoid valve 21 is actuated to its inflating position, the fluid or air pressure is directed into the manifold through inlet 18A causing the piston to be displaced upwardly as seen in FIG. 1. Thus, as the piston passes each of the nipples 15, the associated tube will be inflated causing the inflated tube to exert a massaging pressure on the adjacent body part. It will be noted that each tube 15 is successively inflated as the piston is displaced from its lowermost position to its highest most position as viewed in FIG. 1 to impart a soothing massaging effect on the adjacent body part.

The upper end of the manifold is vented by a suitable vent 25 to the atmosphere. An alternate means for venting the manifold can be achieved by simply providing the manifold with an opening to atmosphere at the upper end thereof.

As the piston reaches or valves the last or uppermost nipple 15B, the timer will cause the solenoid valve 21 to shift to a deflating position whereby the fluid pressure in the manifold and connecting inflatable tubes 15 is exhausted to atmosphere through the solenoid valve.

To return the piston 23 to its initial position as shown in FIG. 1 after reaching the end of its travel, a suitable return means is provided. In the illustrated embodiment, an intermittent motor 26 is provided. It will be understood that the motor is connected in circuit with the timer 22 so as to time its actuation with that of the solenoid valve. In the illustrated embodiment, the motor actuates a spindle 26A, about which a cord 27 is wound, the end of which is connected to the piston 23. The spindle 26A is free to rotate in one direction and is motor driven in the other or reverse direction. Thus, when the piston 23 is displaced under fluid pressure, the cord 27 is free to unwind from the spindle 26A. When the piston 23 reaches its high point and the solenoid 21 is shifted to the deflation position, the motor 26 is activated to drive the spindle 26A in the opposite direction causing the cord 27 to be rewound thereon to pull the piston 23 back to its initial inoperative position. Upon return of the piston 23, the cycle is repeated.

In lieu of a motor, the piston 23 may be connected to a spring means for effecting the return thereof.

From the foregoing, it will be apparent that in operation, the successive inflation of the respective tubes 14 by the action of the piston valving the respective nipples or inlets 15 thereto causes the respective tubes 14 to be successively and progressively inflated in a timed sequence which will impart a pressure on the adjacent body part in a wave-like action. This wave-like action or pressure enhances venous circulation and/or effects a soothing muscular massage on the body part to prevent muscle atrophy.

Figure 5:
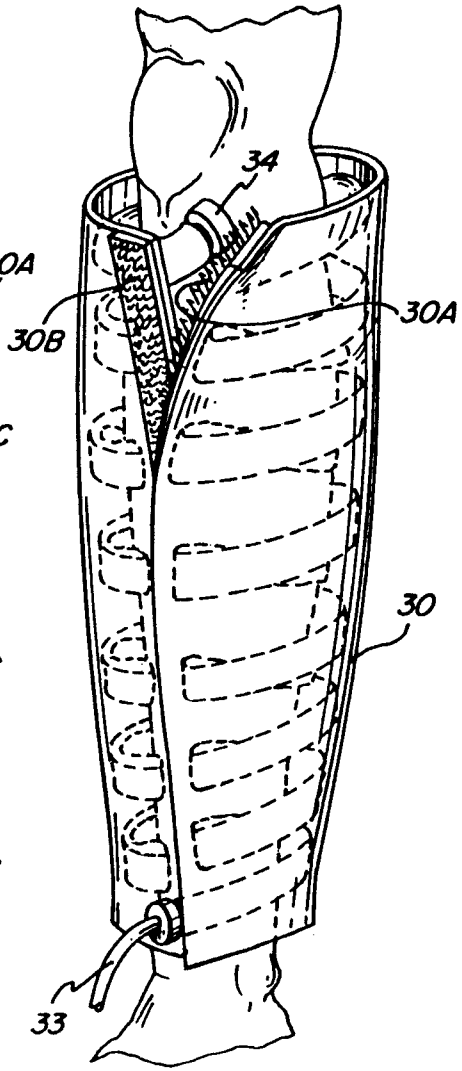
FIG. 5 is a perspective view of the embodiment of FIG. 4 illustrated in an operative position.
Figure 4:
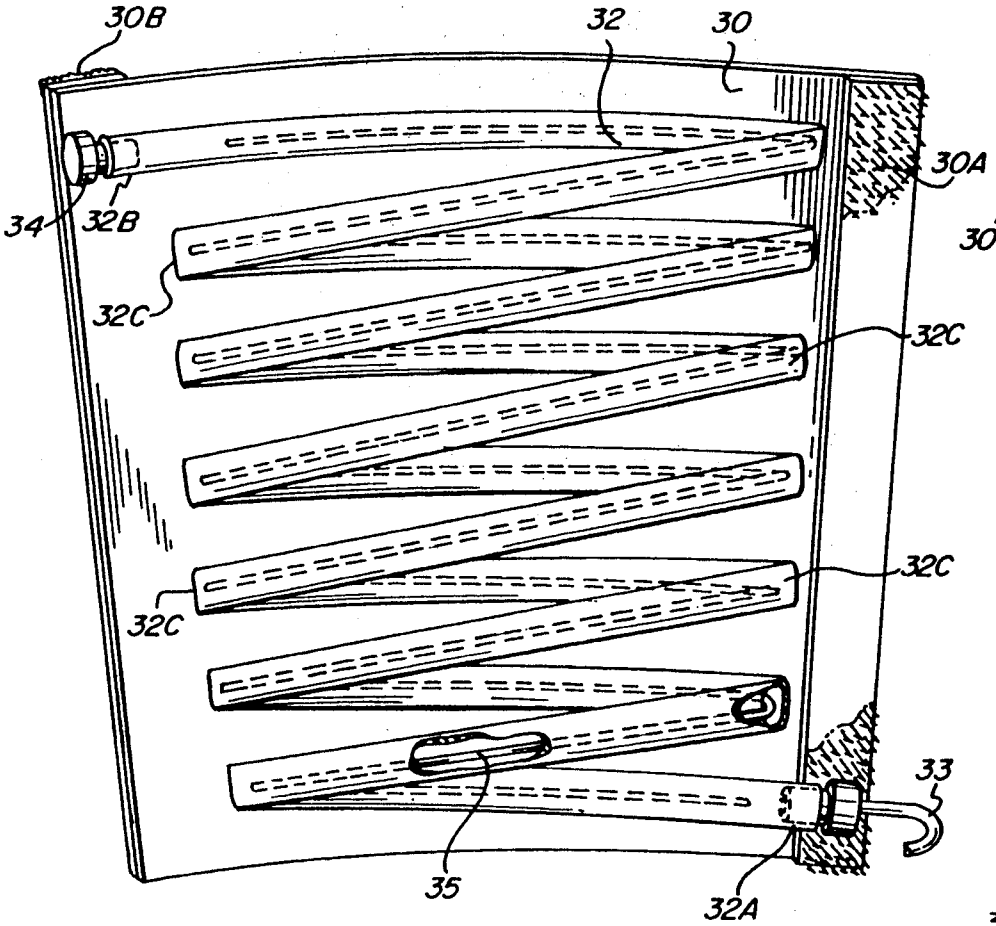
FIG. 4 is a plan view of a modified form of the invention.
Figure 6:
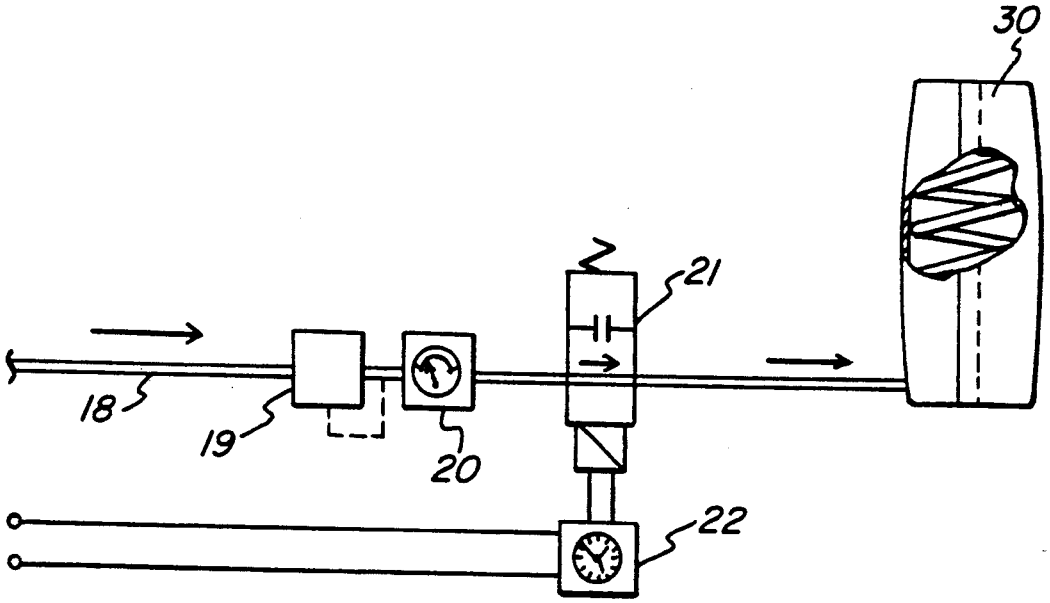

FIGS. 4 and 5 illustrate another embodiment of the invention. In this form of the invention, the shell takes the form of a flat flexible wrap 30, which may be formed of a suitable fabric material. The opposed longitudinal edges of the wrap 30 may be provided with a strip 30A, 30B of a complementary "Velcro" type material. Such strips 30A, 30B comprise a fastening means whereby the wrap 30 when placed about the body part, e.g., a leg, and securely fastened by the interlocking or overlapping of the "Velcro" strips 30A, 30B, as best seen in FIG. 5.

Connected to the inner surface of the wrap 30 is a continuous inflatable tube 32 which is secured thereto in a zigzag pattern, as best seen in FIG. 4. The lower end 32A is connected to a supply conduit 33, which in turn, is connected to a source of fluid supply, e.g. an air compressor. The other end 32B of the tube 32 is suitably sealed, e.g. by a plug 34. Or, in the alternative, the end 32B of the tube can be welded or fusion sealed closed. It will be understood that the supply conduit 33 is connected to a solenoid valve 21 and an associated pressure regulator and pressure gauge, similar as described and shown in FIG. 3. Also connected in circuit with the solenoid valve is a timer 22, as hereinbefore described.

Because the tube 32 is normally flattened in its deflated state, causing the return bends 32C to be crimped as shown, a cord 35 is threaded through the tube 32. The cord 35, having a diameter functions to ensure the maintenance of an open passageway within the tube in the deflated position; and thus prevents total closing of the tube 32 at the return bends 32C, which could prevent inflation of the tube when the solenoid valve is actuated.

When the wrap 30 is secured to the body part as shown in FIG. 5, the operation is similar to that hereinbefore described. With the air compressor operating and the solenoid valve 21 actuated to its inflating position, fluid pressure is directed by means of conduit 33 to the lowermost section of the inflatable tube 32 causing it to inflate. Each section of the zigzag pattern is thereafter successively inflated to impart to the adjacent body part a continuous, wave-like massaging pressure. Positive inflation of each section is assured by the cord 35 threaded thereto. After the last section of the zigzag pattern has been inflated, the timer causes the solenoid valve 21 to shift to its exhaust mode, whereby the fluid pressure within tube 32 is exhausted through the solenoid valve to atmosphere to effect deflation of the tube 32. Thereafter, the cycle is repeated and continued as long as desirable. In this form of the invention, there is a continuous wave-like massaging pressure applied to the body part to enhance circulation and/or to apply a soothing massage on the body part.

If desired, the circuit can be readily connected to a pair of shells or wraps, whereby one of the shells or wrap can be applied, to each leg or arm of a person and be alternately actuated. That is, as one shell is applying a massaging effect to one leg, the other shell is being deflated so that each leg is provided with an alternating body massage pressure.

The tubes are formed of a thin flexible, expandable material which functions as a balloon when inflated to impart a pressure on the body part, and whereby the pressure on the body part is released when the tube is deflated.

From the foregoing, it will be apparent that a relatively simply and positive pressure applying or massaging device is provided for imparting a wave-like pressure on the body part which enhances circulation.

While the invention has been described with respect to particular embodiments thereof, it will be appreciated and understood that variations and modifications may be made without departing from the spirit and scope of the invention.

What is claimed is:

1. A rhythmic pressure applying appliance for improving venous circulation comprising:

sleeve means having opposed ends for encasing a portion of a body to be treated, inflatable means connected to the inner surface of said sleeve means;

said inflatable means being disposed to circumscribe the portion of a body to be treated between said opposed ends of said sleeve, supply means for supplying a fluid pressure to said inflatable means for progressively inflating said inflatable means, said sleeve means comprises a cylindrical member for receiving the portion of a body to be treated, and said inflatable means comprising a plurality of inflatable tubes longitudinally spaced between the opposed end of said cylindrical member, each of said inflatable tubes having a nipple through which a pressure fluid is introduced and exhausted for effectng the inflating and deflating of said tubes, said supply means including an elongated manifold extending longitudinally along the length of said sleeve connected in communication with each of said nipples, a piston reciprocally mounted within said manifold for sequencing the flow of fluid into and out of said nipples, means for introducing a fluid pressure into said manifold for effecting the displacement of said piston within said manifold whereby fluid pressure is sequentially introduced into each of said tubes to effect the inflation thereof as said piston valves said nipples, and a means biasing said piston against the force of said fluid pressure for effecting the return of said piston when sad fluid pressure is cut off to effect deflation of said inflatable tubes, and said biasing means comprising a constant force spring for exerting a pull force on said piston.

2. A rhythmic pressure applying appliance as defined in claim 1 and including spacer means disposed between adjacent inflatable tubes for maintaining the positioning of said inflatable tubes in spatial relationship longitudinally of said cylindrical member.

3. A rhythmic pressure massaging appliance as defined in claim 1 and including:

a valve means disposed between said means for introducing a fluid pressure and said manifold to control the flow of fluid pressure to and from each of said tubes sequentially, said valve means including an exhaust means for deflating sad flexible tubes, and timing means for actuating said valve means for cycling the progressive inflation and deflation of said inflatable tubes.

4. A rhythmic pressure massaging appliance for enhancing venous circulation to a portion of a body to be treated comprising a sleeve adapted to circumscribe a body part to be treated, a plurality of inflatable tubes connected to said sleeve for effecting a massaging pressure on the body part, said inflatable tubes being longitudinally spaced along the length of said sleeve and arranged to circumscribe the body part, means for progressively inflating each of said tubes with a fluid pressure, said means including a supply manifold, communication means for connecting each of said inflatable tubes in communication with said supply manifold, a piston reciprocally mounted within said manifold, a source of fluid pressure connected to said supply manifold, and a valve means disposed between said source and said supply manifold for controlling the flow of fluid pressure to said supply manifold, whereby actuation of said valve means causes said fluid pressure to be directed to said manifold to effect displacement of said piston causing each of said tubes to be sequentially inflated as said piston valves each of said tubes in communication with the fluid pressure in said manifold, said sleeve comprises a pair of sleeve sections, means for hingedly connecting said sleeve sections together for pivoting between an operative and inoperative position, and fastening means for securing said sleeve sections in an operation position, each of said inflatable tubes comprise an elongated tube extending transversely of said sleeve sections so that in the operative position of said sleeve sections, said elongated tube is adapted to encircle the body part, wherein said communication means comprising a nipple connecting said elongated tubes is connected in communication with said supply manifold, said nipple being disposed intermediate the ends of said elongated tube, and including a timing means connected in circuit with said valve means to control the actuation thereof, and a means to returning said piston to its initial position upon the deflation of said inflatable tubes, wherein said piston return means comprises a motor, a spindle operatively connected to said motor, said spindle being free to rotate in one direction and motor driven in the opposite direction, and a cord wound about said spindle, said cord having its free end connected to said piston whereby displacement of said piston under fluid pressure causes said cord to unwind from said spindle, and upon actuation of said motor said spindle is driven in the opposite direction causing said cord to be wound thereon to pull said piston to its initial inoperative position.

* * * * *

UNITED STATES PATENT AND TRADEMARK OFFICE

CERTIFICATE OF CORRECTION

PATENT NO. : 5,245,990

DATED : September 21, 1993

INVENTOR(S) : Millo Bertini

It is certified that error appears in the above-indentified patent and that said Letters Patent is hereby corrected as shown below:

On title page, item [19] and item [76],

Bertinin" should be --Bertini--

Signed and Sealed this

Twenty-second Day of March, 1994

*Attest:*

*Attesting Officer*

BRUCE LEHMAN

*Commissioner of Patents and Trademarks*